US006364032B1

(12) United States Patent
DeCord, Jr. et al.

(10) Patent No.: US 6,364,032 B1
(45) Date of Patent: Apr. 2, 2002

(54) HAND HELD APPARATUS FOR FRACTURING RISERS FROM CASTINGS

(75) Inventors: Frank D. DeCord, Jr., Alabaster, AL (US); Dan Noll, Commerce Township, MI (US); Christopher Cooper, Hoover, AL (US)

(73) Assignee: Action Machinery Company of Alabama, Inc., Helena, AL (US)

( * ) Notice: Subject to any disclaimer, the term of this patent is extended or adjusted under 35 U.S.C. 154(b) by 0 days.

(21) Appl. No.: 09/519,932

(22) Filed: Mar. 7, 2000

(51) Int. Cl.[7] ..... B25D 9/08

(52) U.S. Cl. ..... 173/90; 173/211; 173/212; 173/162.1

(58) Field of Search ..... 173/90, 210, 211, 173/212, 128, 135, 162.1, 162.2

(56) References Cited

U.S. PATENT DOCUMENTS

| | | | | |
|---|---|---|---|---|
| 3,576,246 A | | 4/1971 | Hulet et al. | |
| 3,789,914 A | | 2/1974 | Friesen et al. | |
| 3,892,280 A | * | 7/1975 | Klushin et al. | 173/162.1 |
| 3,955,613 A | | 5/1976 | Lund | |
| 4,099,581 A | | 7/1978 | Maret et al. | |
| 4,299,269 A | | 11/1981 | Friesen et al. | |
| 4,484,638 A | * | 11/1984 | West | 173/90 |
| 5,329,685 A | * | 7/1994 | Gillespie | 173/90 |
| 5,626,457 A | | 5/1997 | Hickman, Jr. | |
| 5,819,857 A | * | 10/1998 | Rohrer | 173/128 |
| 6,138,773 A | * | 10/2000 | Cooper | 173/211 |

* cited by examiner

*Primary Examiner*—Scott A. Smith
(74) *Attorney, Agent, or Firm*—Christopher A. Holland; Robert J. Veal; Burr & Forman LLP

(57) ABSTRACT

A hand held-type apparatus for fracturing a gate or riser from a casting subsequent to a foundry pouring process. The apparatus operates off of a driven piston assembly, which upon a stroke of such causes a hammer end of the piston assembly to extend from the apparatus and contact the casting, thereby causing the fracturing of the gate or riser from the casting. The apparatus also includes an assembly for decelerating the driven piston assembly upon a stroke of such, as well as an apparatus for isolating the linear motion of the apparatus from the operator thereof.

17 Claims, 9 Drawing Sheets

HAND HELD APPARATUS FOR FRACTURING RISERS FROM CASTINGS

FIELD OF THE INVENTION

The present invention relates to equipment used in the foundry industry, and more particularly to the specific equipment used to fracture a riser or flashing from a casting subsequent to the foundry pouring process. Even more particularly, the present invention relates to a hand held single stroke foundry impactor for fracturing a riser from cast products. With even greater particularity, the present invention relates to a hand held foundry impactor having an apparatus for decelerating and absorbing the excess kinetic energy of the impacting rod and piston assembly within the impactor upon a miss or partial miss of the target riser or flashing. Further yet, the present invention relates to a hand held foundry impactor having an apparatus for absorbing the linear kinetic energy of the impactor such that a single operator is able to efficiently and safely operate the impactor without being subjected to the forces generated by the impacting of a cast product by the impactor.

BACKGROUND OF THE INVENTION

The foundry industry has long been accustomed to the processes associated with the removal of excess cast material from cast products. In the typical foundry operation, the pouring of molten cast into molds inevitably leaves an excess portion of cast material extending from the cast product subsequent to the cooling of the molten material. This excess portion, often termed a neck or riser, is formed as a result of molten cast remaining in the pour hole of the mold during the pouring and cooling process. Once the exterior mold is removed from the cast product, the cast material previously remaining in the mold pour hole becomes riser extending from the cast product. This riser must be removed from the casting in order to yield a finished cast product.

Currently, the foundry industry generally relies upon extremely dated, crude, and inefficient technology to remove the excess cast material formed when molten cast is poured into a mold. According to industry custom and practice, foundry operations typically utilize a process following the pouring of a cast product which essentially comprises the steps of removing the entire cast product from the surrounding mold and manually impacting the unwanted excess cast material until fracturing occurs, such that the excess cast material is able to be removed. This manual impacting operation is commonly performed by a worker with crude manual labor implements such as a heavy mallet or sledge hammer. Using these human operated heavy mallets and sledges to impact casting riser often results in near or complete misses of the riser and the subsequent damaging of the casting itself. Additionally, attempting to fracture a riser from a casting with a sledge or mallet will often require many blows at a high level of risk to both the worker and the integrity of the casting.

A minority of foundry operations employ manually operated explosive powder driven hammers to fracture a riser from the casting. Although technologically more advanced than mallets and sledge hammers, these explosive powder driven hammers are subject to many of the same problems and limitations associated with the manual sledge and mallet operations. Manually operated explosive powder driven hammers are known to damage the main body of the cast products upon a near or complete miss of the riser intended to be fractured, as the intended fracturing force is then absorbed by the body of the casting causing damage. The explosive powder driven hammers are additionally subject to a limitation and disadvantage in that they are unable to control the level of force generated for each individual impacting, and often impact with excessive force causing damage to the body of the casting. The impacting force delivered by an explosive powder driven hammer is predetermined by the size of the explosive powder casing inserted within the hammer prior to impacting, which is a standard shell casing size and not variable. Explosive powder impacting hammers are additionally cumbersome, inconvenient, and unreliable for foundry use. Manual operation of an explosive powder impactor requires the exchange of a new explosive powder shell after every attempted impact or firing. Explosive powder impacts also require frequent maintenance tear-downs due to the extreme pressures and stresses upon the impactor components. In addition to the above-mentioned methods of fracturing, there are also additional uses of both hydraulic wedges and cutting torches in the industry to remove riser. The use of torches and wedges, although probably predominate in the industry, is nonetheless a very time consuming and inefficient method or process for removing a riser from a cast product. Therefore, there is a well-found need in the foundry industry for an apparatus capable of accurately and efficiently fracturing excess cast material from castings using only a single operator.

SUMMARY OF THE INVENTION

As a result of the aforementioned need in the foundry industry, it is the object of the present invention to provide a hand held foundry impactor capable of accurately, safely, and efficiently fracturing a riser or excess cast material from a casting. It is a further object of the present invention to provide a hand held single stroke foundry impactor capable of being efficiently and safely operated by a single operator. It is yet a further object of the present invention to provide a hand held single stroke foundry impactor having an apparatus for absorbing the residual kinetic energy of the impactor piston and rod assembly upon a stroke of such. It is still a further object of the present invention to provide a hand held single stroke foundry impactor having a shock absorption assembly attached thereto for isolating the force generated by the impactor from the operator upon actuation of the impactor. Other features, objects, advantages, and methods of use of the present invention will become apparent from a thorough reading of the following description as well as a study of the appended drawings and diagrams.

BRIEF DESCRIPTION OF THE DRAWINGS

The apparatus embodying features of the invention are illustrated in the enclosed drawings which form a portion of this disclosure and wherein.

DESCRIPTION OF THE PREFERRED EMBODIMENT

Figure 1:
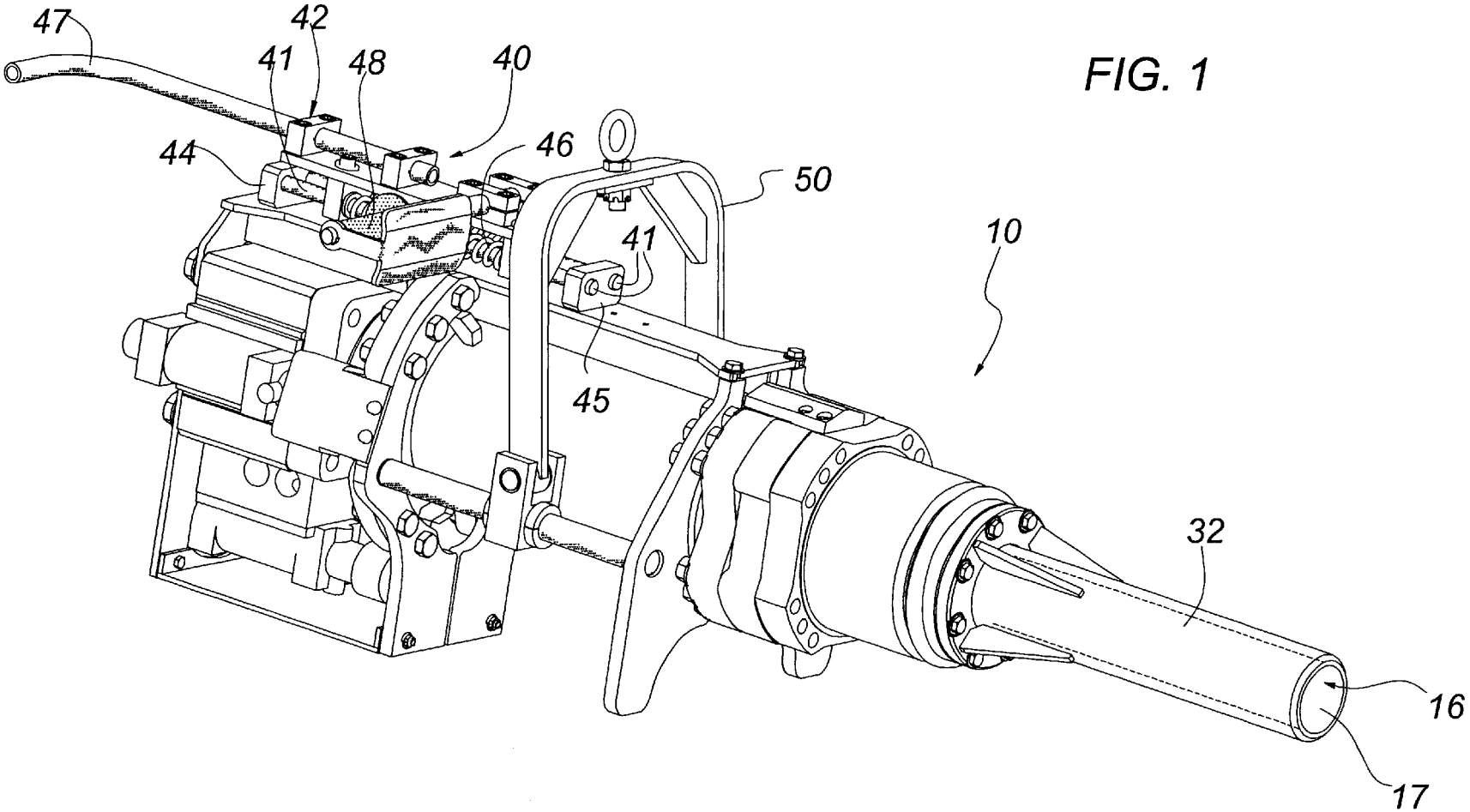
FIG. 1 is a perspective view of the hand held impactor.
Figure 2:
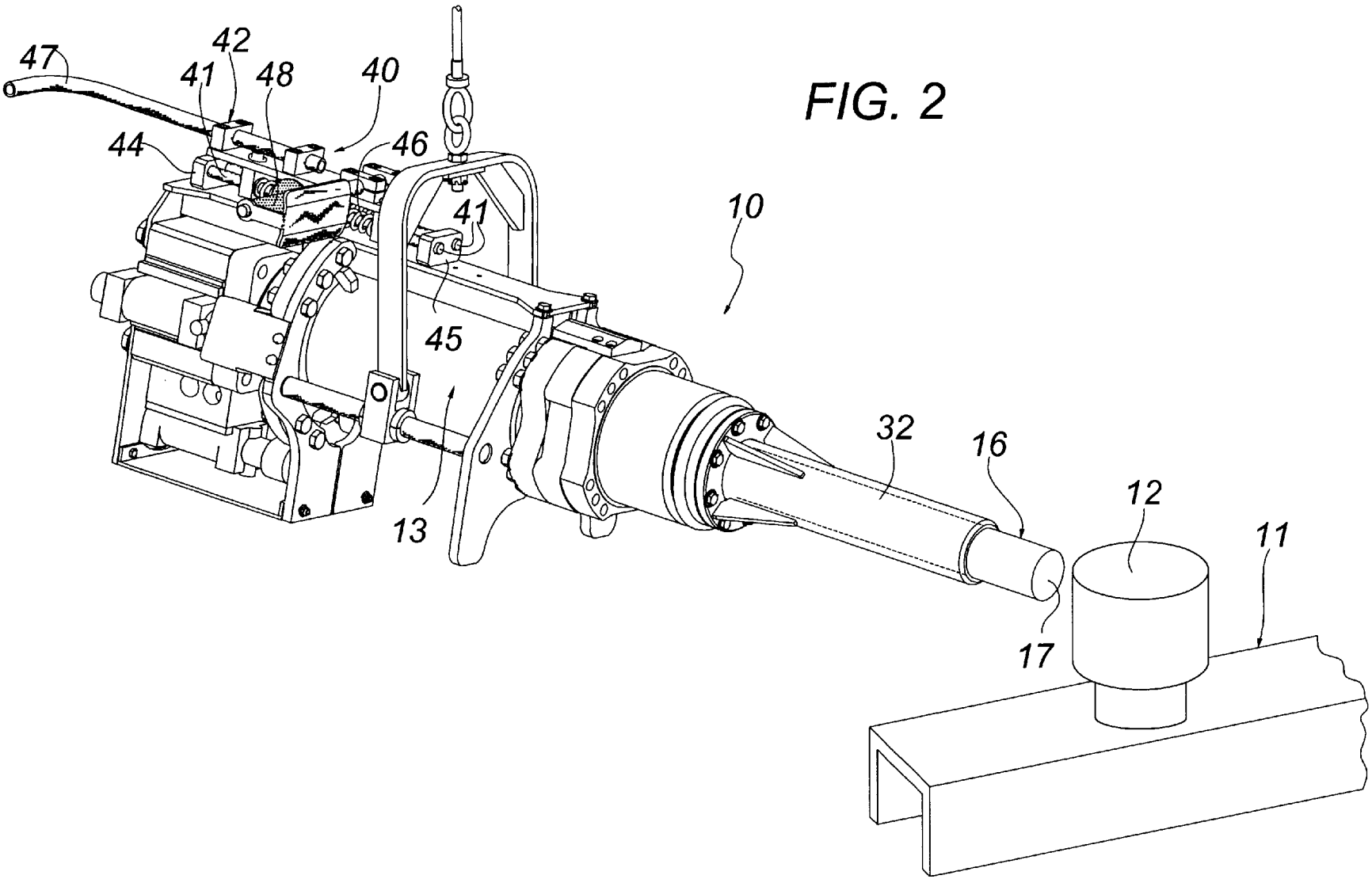
FIG. 2 is a perspective view of the hand held impactor positioned proximate a riser to be fractured from a cast product.

Referring to the drawings for a better understanding of the principles of operation and structure of the invention, it will be seen that FIG. 1 shows a perspective view of hand held foundry impactor 10. Generally speaking, impactor 10 is often suspended from an overhead structure via sling 50, such that nearly all of the impactor 10 weight is supported by the respective overhead structure. Further, in operation, impactor 10 is generally positioned proximate a casting 11 having a riser 12 extending therefrom, as shown in FIG. 2, such that the longitudinal axis of impactor 10 is aligned with riser 12 to be fractured from casting 11. Subsequent to alignment of impactor 10 with riser 12, the operator activates impactor 10, such that riser 12 is impacted and fractured from casting 11 via contact with the impacting end 17 of a force transferring rod 16 as it extends from snout 32.

Figure 3:
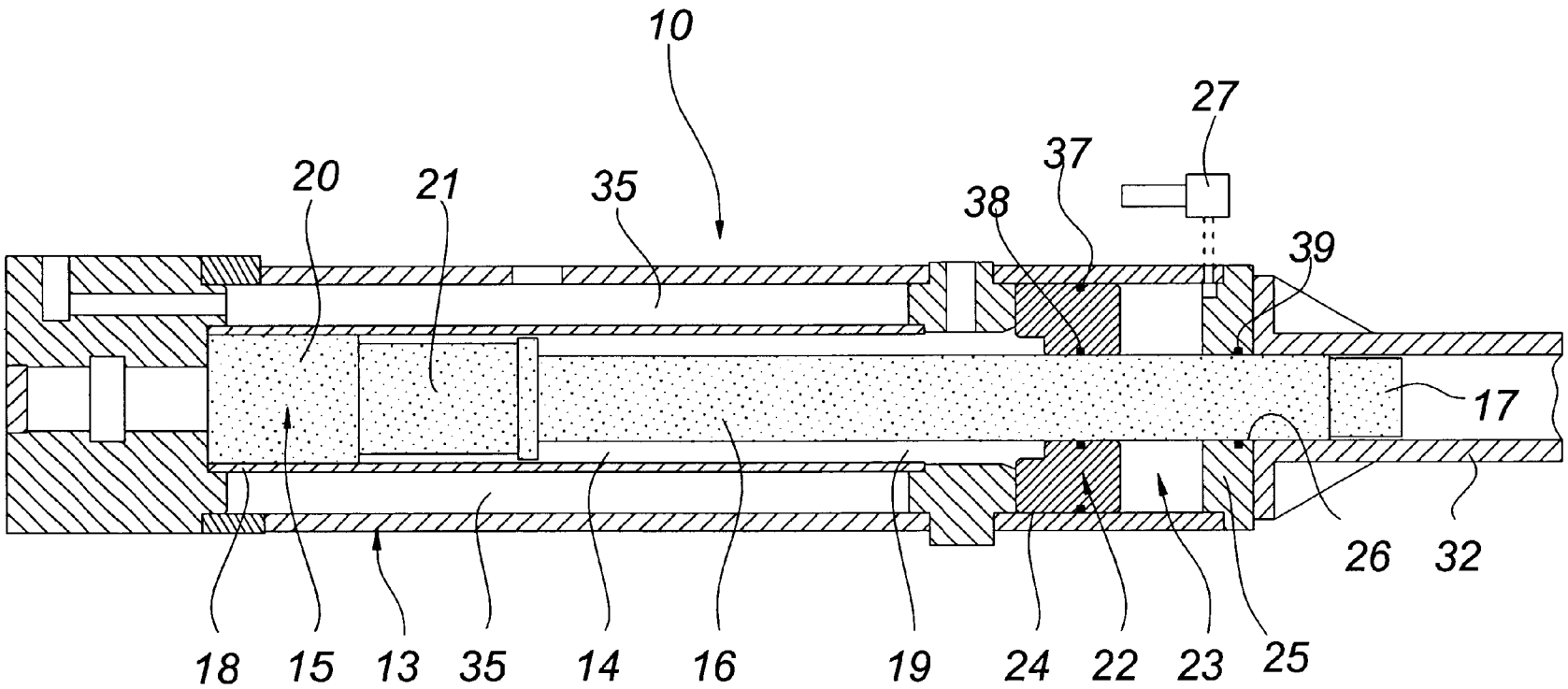
FIG. 3 is a detail of the impactor in the ready to fire position.

With particularity, the internal operational components of hand held impactor 10 are clearly illustrated in FIG. 3. Hand held impactor 10 comprises an elongated outer casing 13 having a concentric inner bore formed therein defining an elongated power barrel 14. Further, a substantially hollow outer sleeve defining an air reservoir 35 is concentrically positioned about the same axis as power barrel 14 and is in fluid communication with a pressurized air supply. Power barrel 14 contains an elongated piston assembly 15 slidably mounted therein for actuated longitudinal movement within power barrel 14 upon selective pressurization of power barrel 14, which will be further discussed herein. The upper portion 20 of piston assembly 15 is of sufficient diameter to slidably engage the interior walls of power barrel 14, while the lower portion 21 of piston assembly 15 is of a sufficiently smaller diameter, such that lower portion 21 is not in contact with the interior walls of power barrel 14 upon longitudinal movement of piston assembly 15. Piston assembly 15 further includes an elongated force transferring rod 16 extending therefrom along the longitudinal axis of piston assembly 15 proximate the terminating end of lower portion 21. Force transferring rod includes a longitudinally displaceable terminating impacting end 17 for impacting a riser to be fractured from a casting upon a longitudinal stroke of piston assembly 15 within power barrel 14.

Coaxially affixed to casing 13 immediately adjacent head end 19 of power barrel 14 is a deceleration chamber 23. Deceleration chamber 23 comprises a longitudinally continuous outer wall forming a substantially cylindrical inner chamber aligned with the longitudinal axis of power barrel 14. Slidably positioned within deceleration chamber 23 is an annularly shaped deceleration piston 22, which cooperatively receives force transferring rod 16 therethrough. Deceleration chamber 23 includes a first open end 24 in fluid communication with head end 19 of power barrel 14, and a second substantially closed end 25 having only a coaxially positioned longitudinally aligned bore 26 formed therein for cooperatively and concentrically receiving force transferring rod 16 therethrough to impactor snout 32. Open end 24 of deceleration chamber 23 is rigidly mounted to head end 19 of power barrel 14 along the same longitudinal axis as power barrel 14. Snout 32 is rigidly mounted to closed end 25 of deceleration chamber 23 along the longitudinal axis of power barrel 14 and operates both to communicate force transferring rod 16 and impacting end 17 to the exterior of impactor 10, and to align impacting end 17 with the target riser 12 to be fractured from a casting 11. Snout 32 is generally of a conical shape and contains a substantially hollow interior portion for communicating force transferring rod 16 therethrough to the exterior of impactor 10.

A deceleration chamber pressurization valve 27 is positioned proximate closed end 25 of deceleration chamber 23. Pressurization valve 27 is a selectively actuated bi-directional valve in fluid communication with both a pressurized air supply and the ambient atmosphere. Valve 27 operates to selectively pressurize deceleration chamber 23, such that deceleration piston 22 is urged to slide to a position proximate open end 24 of deceleration chamber 23 in preparation for engaging piston assembly 15 upon completion of an impacting stroke. Further, the pressurization of deceleration chamber 23 firmly biases deceleration piston 22 towards power barrel 14, thus operating to resist and decelerate the longitudinal motion of piston assembly 15 upon engagement of such. Alternatively, valve 26 also serves to selectively depressurize deceleration chamber 23 to atmospheric pressure during maintenance periods, such that any excess oil or unwanted particles that may hinder proper operation of deceleration piston 20 can be purged or allowed to escape from deceleration chamber 23.

Figure 9:
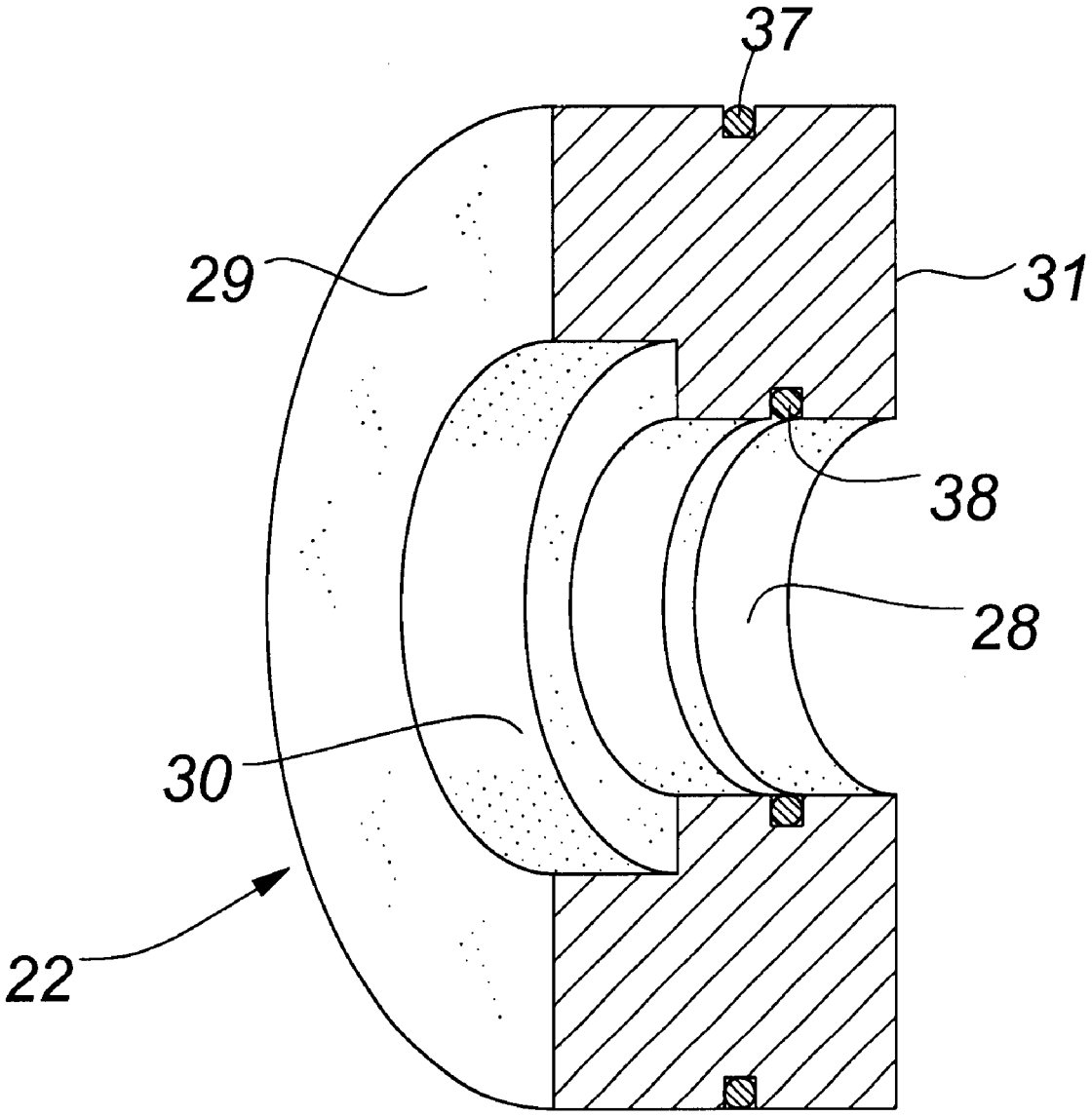
FIG. 9 is a perspective view of the deceleration piston.

Specifically, deceleration piston 22, as shown in FIG. 9, comprises a circular disk shaped member having an axial bore 28 formed therein for slidably receiving force transferring rod 16 therethrough; thus, deceleration piston 22 is generally annular in shape. Power barrel side 29 of deceleration piston 22 includes an axially formed recess 30 in the form of a partial bore of sufficiently larger diameter than axial bore 28 to accommodate lower portion 21 of piston assembly 15 upon engagement of piston assembly 15 by deceleration piston 22. Opposite power barrel side 29 of deceleration piston 22 is deceleration chamber side 31 of deceleration piston 22, which is generally planar in form. Further, inasmuch as longitudinally aligned bore 26 on closed end 25 and axial bore 28 both slidably receive force transferring rod 16 therethrough, the diameter of these particular bores is also slightly larger than that of force transferring rod 16, thereby allowing for rod 16 to slide within the respective bores. Furthermore, inasmuch as deceleration piston 22 is continually engaging and absorbing the kinetic energy of piston assembly 15, deceleration piston 22 must be manufactured from a structurally resilient material capable of continually absorbing the forces associated with contacting piston assembly 15 without critical failure. As such, deceleration piston 22 is generally manufactured from a structurally sound non-metallic material.

In order to maintain pressurization of deceleration chamber 23 and the resulting biasing force of deceleration piston 22 during operation of impactor 10, deceleration piston 22 is equipped with two sets of pressure seals, which are generally known in the art. First pressure seal 37 is positioned about the outer circumference of deceleration piston 22 in similar fashion to a common ring seal type arrangement, such that a seal is formed between the outer circumference of deceleration piston 22 and the interior wall of deceleration chamber 23. Second pressure seal 38 is positioned about the circumference of axial bore 28 of deceleration piston 22, again in similar fashion to ring type seals, such that a seal is formed between axial bore 28 and the outer surface of force transferring rod 16. Although not located on deceleration piston 22, a third pressure seal 39 located between longitudinally aligned bore 26 in closed end 25 of deceleration chamber 23 and force transferring rod 16 completes the pressurization seals of deceleration chamber 23 by sealing chamber 23 from the exterior of impactor 10.

The presence of these pressure seals allows for the selective pressurization of deceleration chamber 23, such that deceleration piston 22 is firmly biased against longitudinal movement.

During a stroke of impactor 10, piston assembly 15 is longitudinally displaced within power bore 11 through the selective introduction of fluid pressure into power barrel 14 via a system of selectively actuated valves. Generally speaking, piston assembly 15 is urged to longitudinally travel from blind end 18 of power barrel 14 towards the head end 19 via fluid pressurization of blind end 18 of power barrel 14. This longitudinal movement concomitantly acts to extend impacting end 17 of force transferring rod 16 beyond the exterior of casing 13 through snout 32, such that casting 11 may be impacted and riser 12 fractured therefrom. In order to return piston assembly 15 to blind end 18 of power barrel 14 in preparation for subsequent impacting strokes, head end 19 of power barrel 14 is pressurized such that piston assembly 15 is urged to longitudinally return to blind end 18.

Figure 4:
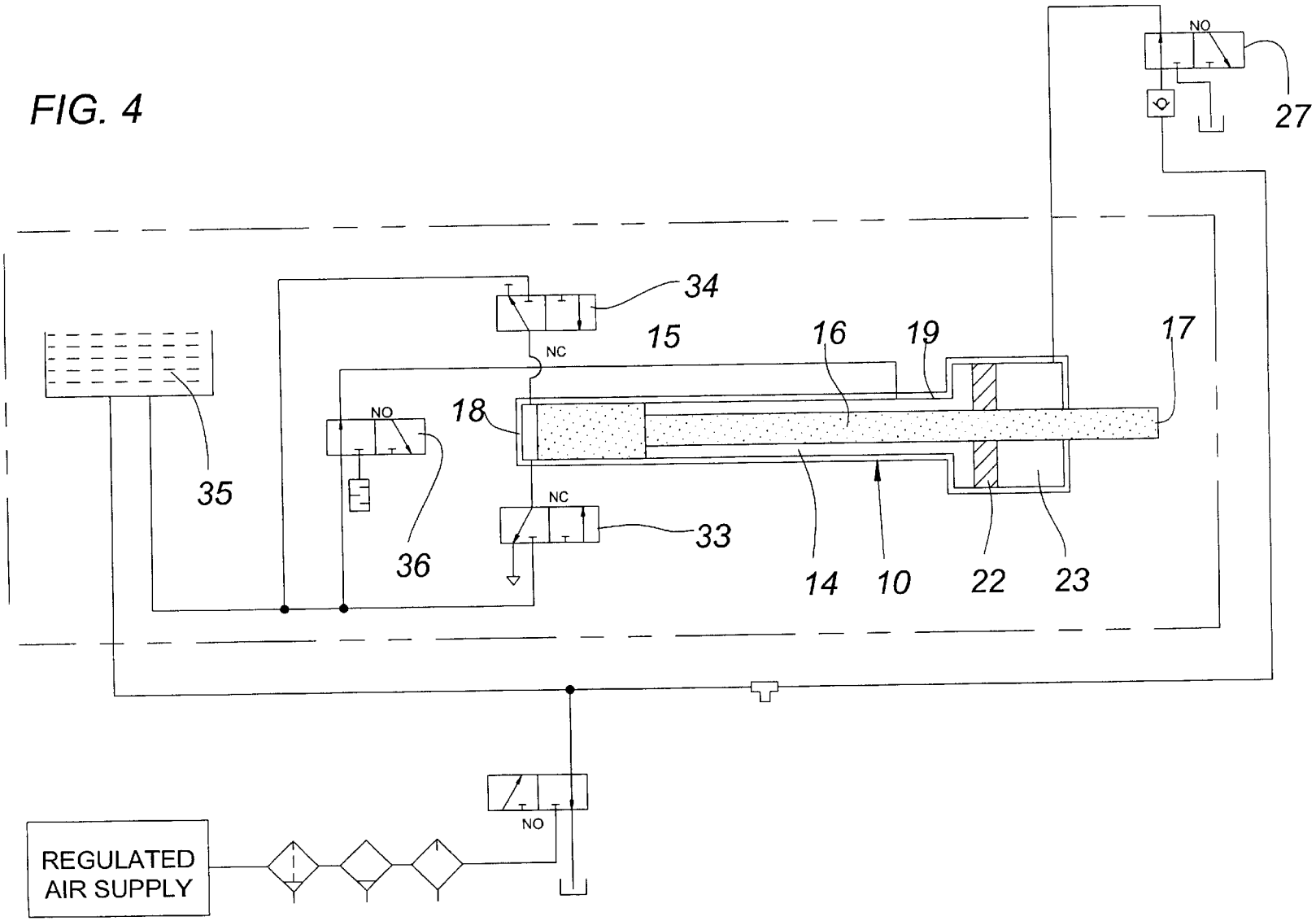
FIG. 4 is a schematic of the impactor valving system.
Figure 5:
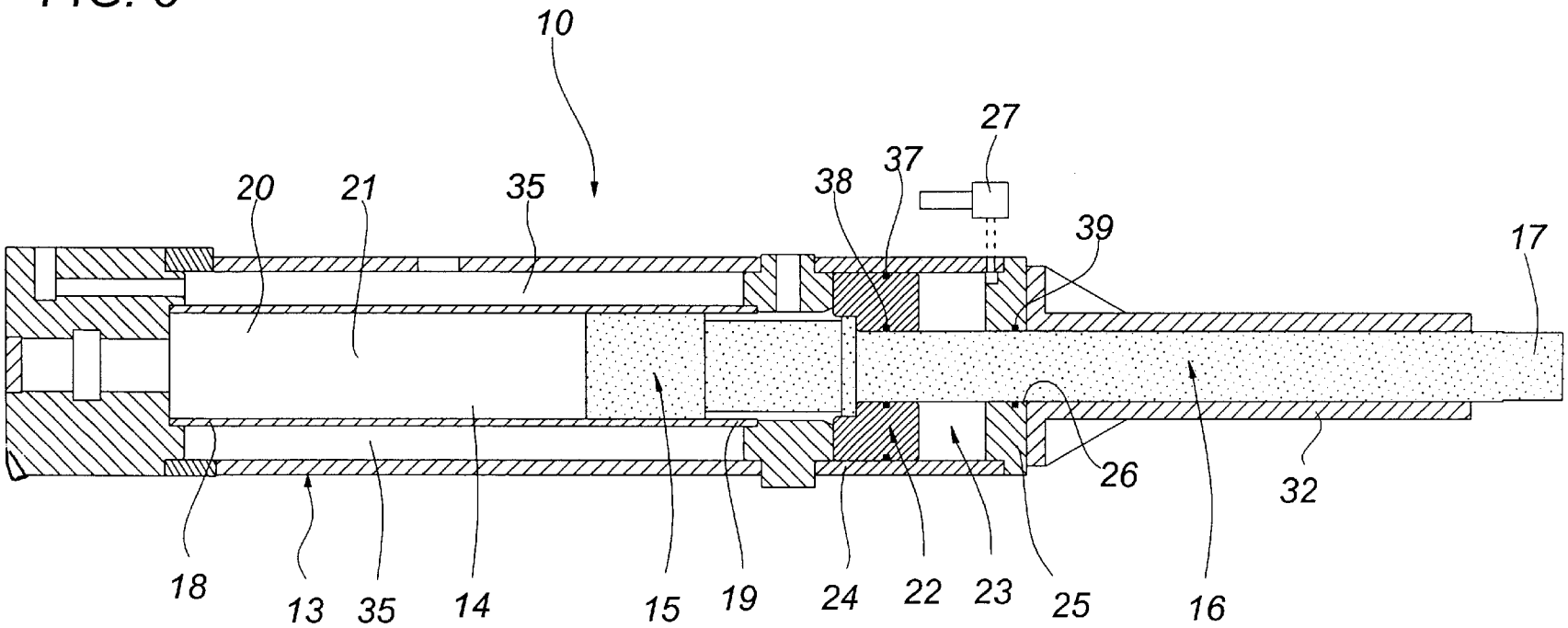
FIG. 5 is a detail of the impactor with the hammer end partially extended.
Figure 6:
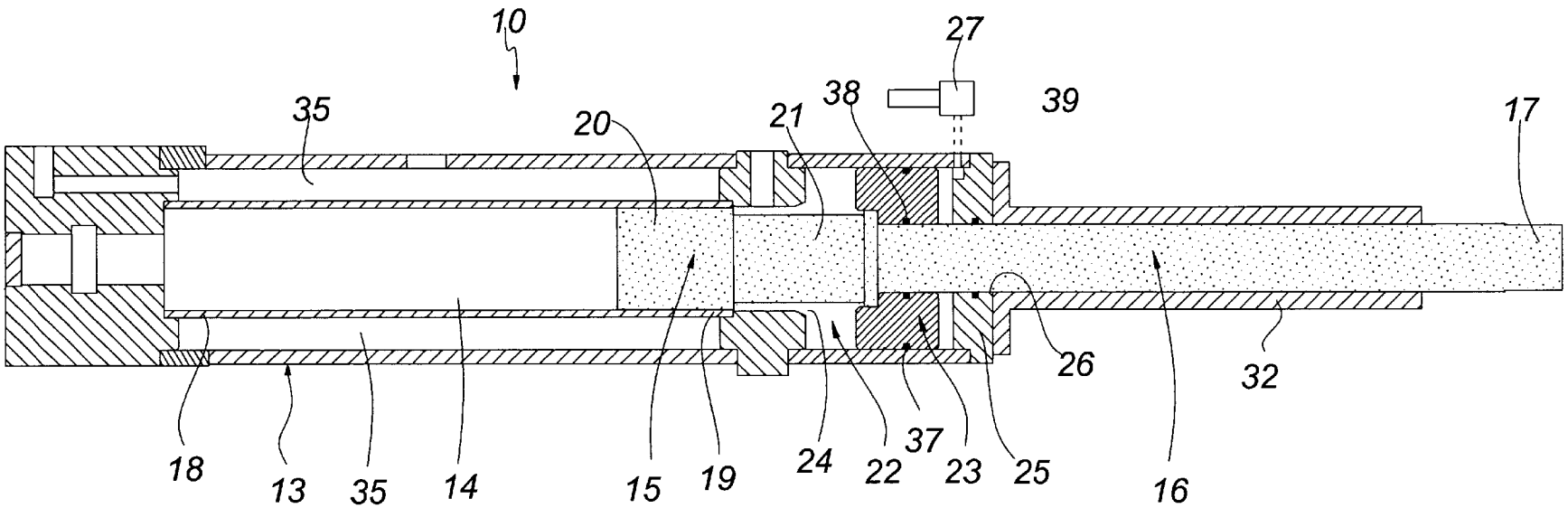
FIG. 6 is a detail of the impactor assembly having the hammer end fully extended with the volume of air in the deceleration chamber partially compressed.
Figure 7:
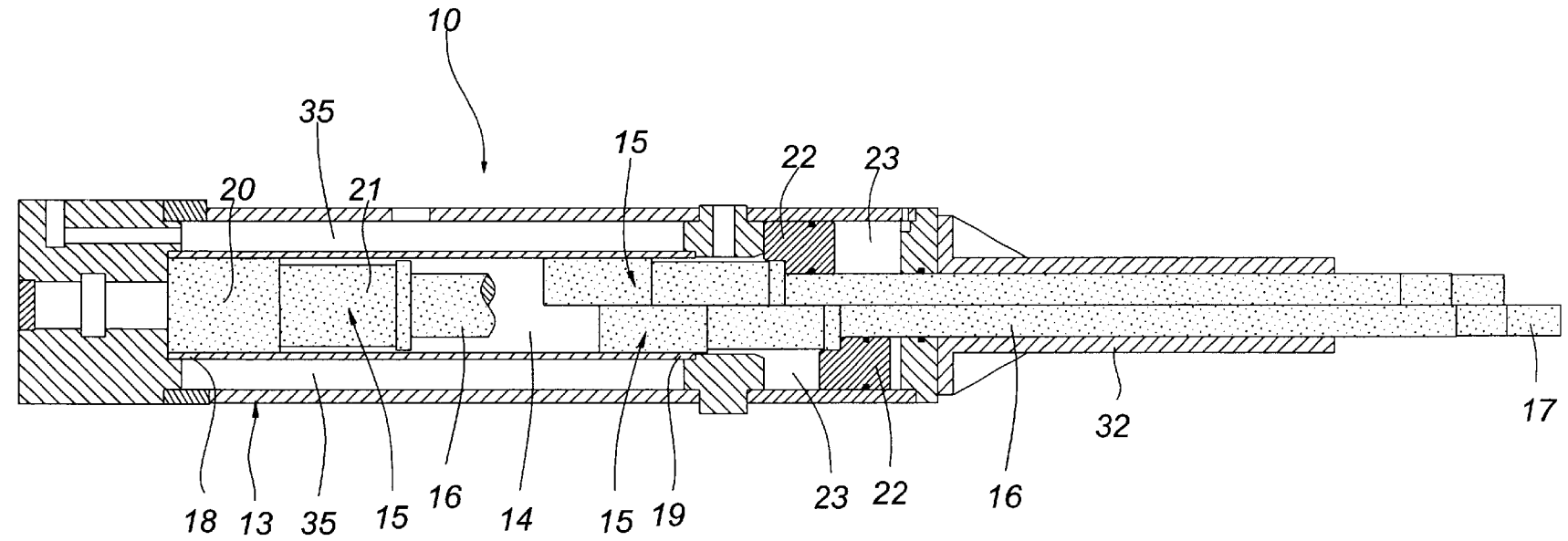
FIG. 7 is a cutaway of the impactor showing the cushion piston in both the normal and compressed positions.
Figure 8:
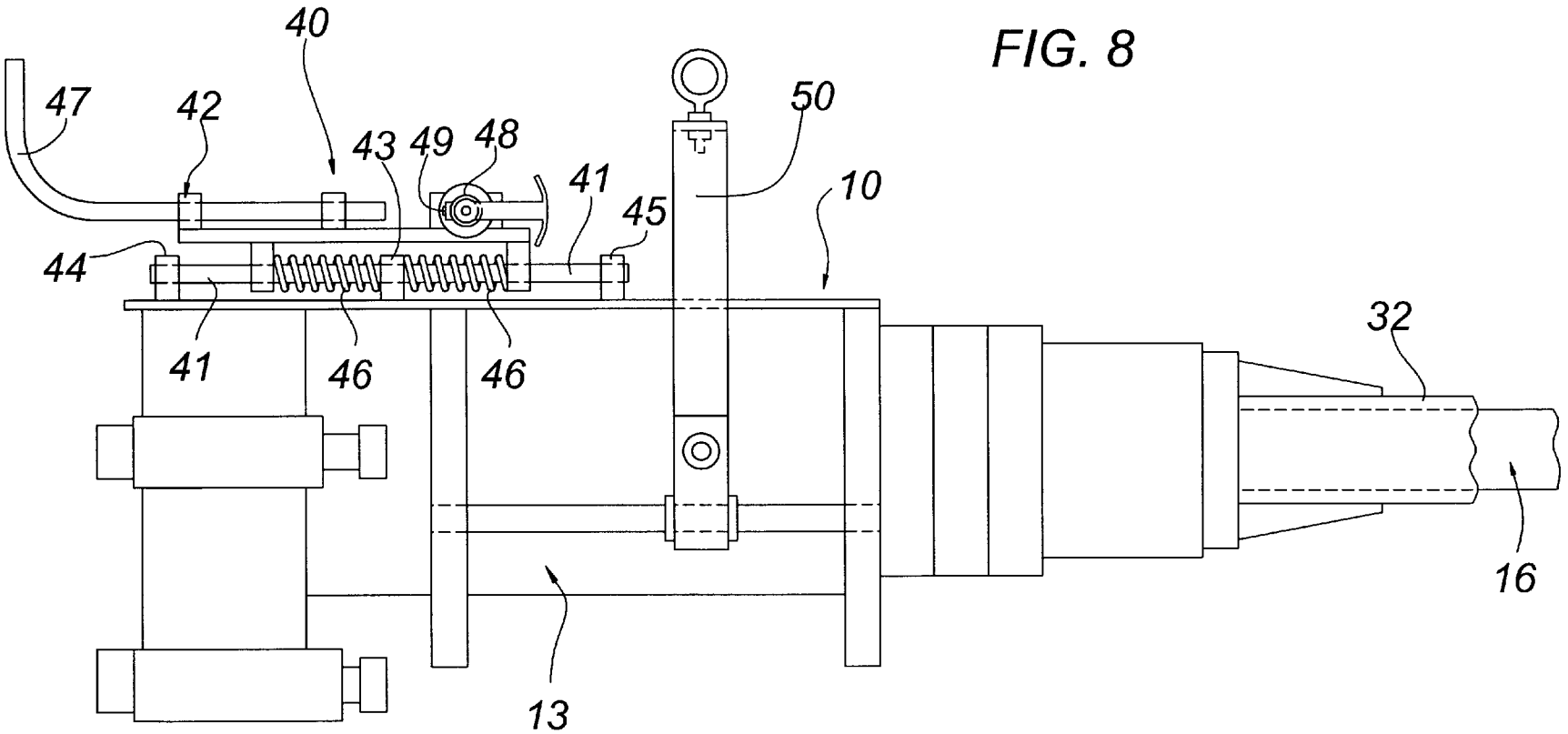
FIG. 8 is a detail of the shock absorption assembly.

With particularity, the system of valves utilized to selectively introduce fluid pressure to power barrel 14 for the purpose of selectively imparting longitudinal motion to piston assembly 15 is schematically shown in FIG. 4. Two valves, the main fire/return exhaust valve 33 and the high fire valve 34, are positioned in the blind end 18 of power barrel 13. The main fire/return exhaust valve 33 operates to both pressurize the upper portion of power barrel 14 in a normal firing mode, as well as to vent blind end 18 of power barrel 14 to atmospheric pressure during longitudinal movement of piston assembly 15 towards blind end 18 in the return portion of the stroke. High fire valve 34 operates only to cooperatively pressurize blind end 18 of power barrel 14 with main fire/return exhaust valve 33 at a much faster rate when impactor 10 is operated in a high fire mode. High fire 34 and main fire/return exhaust 33 valves are in fluid communication with pressurized air reservoir 35, which is used to pressurize power barrel 14 such that piston assembly 15 is urged to rapidly slide within power barrel 14. A third valve positioned upon impactor 10 is the exhaust and return valve 36, which is positioned proximate the head end 19 of power barrel 13. Exhaust and return valve 36 is also in fluid communication with reservoir 35, and operates to both pressurize the lower portion of power barrel 14 to urge piston assembly 15 to return to the blind end 18 of power barrel 14 upon completion of an impacting stroke, as well as to vent the head end 19 of power barrel 14 to atmospheric pressure during the impacting stroke. Venting of head end 19 to atmospheric pressure by exhaust and return valve 36 serves to increase the output power of the impactor, as the resistive force on the piston assembly as a result of air pressure is minimized when valve 36 is vented to atmospheric pressure.

The exterior of casing 13 of impactor 10 includes a shock absorption assembly 40 mounted thereto for the operator of impactor 10 to grip and control the apparatus from. Shock absorption assembly 40 serves to isolate the operator from any longitudinal movement of impactor 10 upon contact with a casting. Shock absorption assembly 40 includes a pair of elongated rail members 41 rigidly mounted to impactor casing 11 along the longitudinal axis of such and in parallel relation to each other. Rail members 41 are mounted to casing 13 at first 44 and second 45 terminating ends, as well as at the midpoint 43, thus, rail members 41 are rigidly mounted to casing 13 at three specific locations. An operator handle assembly 42 is slidably attached to rail members 41 at two points; the first point being between the midpoint mount 43 and a first terminating 44 end of rail members 41, and the second point being between the midpoint 43 and a second terminating end 45 of rail members 41. This mounting configuration allows handle assembly 42 to slidably travel along rail members 41 between the midpoint mount 43 and the terminating end mounts. The operator grips handle assembly 42 at a first handle 47 positioned proximate the rear of impactor 10 with one hand, while concurrently gripping handle assembly 42 at a second handle 48 positioned proximate the middle casing 13. Second handle 42 also includes a thumb trigger 49 for initiating the impacting stroke of impactor 10. Handle assembly 42 is additionally biased to a rest position by a pair of opposing biasing springs 46 positioned proximate rail members 41. As a result of this biasing, handle assembly 42 is able to slidably absorb a substantial portion of the linear kick back of impactor 10 upon an impacting stroke, and as such, motion of the impactor 10 is damped or isolated from the operator by biasing springs 46.

Upon initiation of impactor 10 by the operator's actuation of thumb trigger 49, the aforementioned valves begin a specific sequence, which causes impactor 10 to stroke and impact a riser 12. Assuming that piston assembly 15 is located proximate blind end 18 of power barrel 14 in the ready to fire position commonly known as top dead center, the impacting sequence begins with the opening of exhaust and return valve 36, such that head end 19 of power barrel 14 is vented to atmospheric pressure. Immediately after venting head end 19, in normal fire mode, main fire/return exhaust valve 33 is opened for a predetermined period of time, such that the volume of pressurized air in reservoir 35 becomes in fluid communication with blind end 18 of power barrel 14. This pressurizes the blind end 18 of power barrel 14, and therefore rapidly urges piston assembly 15 to longitudinally travel towards head end 19 of power barrel 14. This motion acts to longitudinally extend impacting end 17 of force transferring rod 16 outside snout 32 for contact with riser 12. If the impactor is operated in the high power firing mode, which offers a greater impacting force for larger risers and such, essentially the same valve sequence is utilized. However, in the high fire mode, high fire valve 34 is simultaneously opened with main fire valve 33. The simultaneous opening of high fire 34 and main fire 33 valves operates to pressurize blind end 18 of power barrel 14 at a much faster rate, thus imparting a substantially greater force to piston assembly 15 and impacting end 17.

Proximate the end of the impacting stroke, lower portion 21 of piston assembly 15 contacts deceleration piston 22 and is received within recess 30. Thereafter, deceleration piston 22 and piston assembly 15 begin to concomitantly travel longitudinally within deceleration chamber 23. However, as the components longitudinally travel, the volume of air in deceleration chamber 23 is proportionally compressed by deceleration piston 22, which results in an increased force resisting further longitudinal motion. Therefore, the concomitant longitudinal motion of deceleration piston 22 and piston assembly 15 is quickly decreased to a stop as a result of the proportionally increasing resistive force. Subsequent to completing the impacting stroke, piston assembly 15 must be returned to the top dead center position in preparation for another firing. Therefore, main fire/return exhaust valve 33 is positioned such that power barrel 14 is no longer being pressurized and piston assembly 15 is no longer being urged towards head end 19 of power barrel 14. In order to urge piston assembly 15 towards blind end 18 of power barrel 14, exhaust and return valve 33 is positioned such that the head end 19 of power barrel 14 is in communication with reservoir 35, which pressurizes head end of power barrel 14. This pressurization urges piston assembly to travel towards blind end 18 of power barrel 14 to the top dead center position. When piston assembly 15 reaches the top dead center position, impactor 10 is ready for another impacting stroke.

As a result of deceleration piston 22 continuously receiving and absorbing the kinetic energy of piston assembly 15 and force transferring rod 16 upon a stroke of impactor 10, it is critical that deceleration piston 22 be manufactured of a material capable of continually absorbing such kinetic energy while maintaining structural integrity. Thus, rigid metallic compounds commonly utilized to construct piston assemblies, such as iron and aluminum compounds, are to be avoided, as the potential for metal fatigue and fracture as a result of continuous impacting is high. Therefore, in the preferred embodiment, deceleration piston 22 is manufactured from a non-metallic compound. Particularly, it is contemplated within the scope of the present invention to manufacture deceleration piston 22 from nylon, a family of high-strength, resilient synthetic polymers, the molecules of which contain the recurring amide group CONH, or equivalents. The use of these compounds dramatically increases the ability of deceleration piston 22 to resist fracturing due to continuous high energy impacts with piston assembly 15, and therefore the life span of deceleration piston 22 and the impactor as a whole is dramatically increased. Specifically, it is contemplated that a nylon compound be utilized to manufacture deceleration piston 22, as such compounds offer the high material strength properties of the previously utilized metallic compounds without the tendency to fracture and cause critical failure of the apparatus 10. With even greater particularity, the preferred embodiment illustrated herein utilizes a heat stabilized type six polyamide resin nylon compound for the manufacture of the deceleration piston 22, as this material offers substantial structural strength capable of absorbing thousands of impacts with piston assembly without fracturing or otherwise causing a critical failure of the impactor 10.

It is to be understood that the form of the invention shown is a preferred embodiment thereof and that various changes and modifications may be made therein without departing from the spirit of the invention or scope as defined in the following claims.

What is claimed is:

1. A hand held single stroke foundry impactor for fracturing a gate or riser from a cast product comprising:

a) an elongated casing having an axially formed bore therein defining a power barrel, said power barrel having a head end and a blind end;

b) a piston assembly slidably positioned within said power barrel, said piston assembly having an axially extending force transferring rod extending therefrom, said force transferring rod having a distal extending impacting end;

c) means for imparting longitudinal motion to said piston assembly within said power barrel via the selective introduction of fluid pressure into said power barrel, thereby causing said piston assembly to selectively stroke within said power barrel;

d) means for decelerating said piston assembly at the end of a stroke; and e) means for isolating the longitudinal motion of said impactor from the operator thereof.

2. A hand held single stroke foundry impactor for fracturing a gate or riser from a cast product as defined in claim 1, wherein said means for imparting longitudinal motion to said piston assembly within said power barrel via the selective introduction of fluid pressure into said power barrel further comprises:

a) a source of fluid pressure;

b) at least one bi-directional impactor firing valve in fluid communication with said blind end of said power barrel and said source of fluid pressure, such that said at least one impactor firing valve operates to selective introduce and relieve fluid pressure within said blind end of said power barrel, thereby causing said piston assembly to longitudinally travel towards said head end of said power barrel upon fluid pressurization of said blind end by said firing valve; and c) a bi-directional impactor exhaust and return valve in fluid communication with said head end of said power barrel and said source of fluid pressure, such that said impactor exhaust and return valve operates to selectively introduce and relieve fluid pressure within said head end of said power barrel.

3. A hand held single stroke foundry impactor for fracturing a gate or riser from a cast product as defined in claim 1, wherein said means for decelerating said piston assembly at the end of said stroke further comprises:

a) a substantially cylindrical deceleration chamber of greater diameter than said power barrel having a first substantially open terminating end and a second substantially closed terminating end, said first terminating end being rigidly mounted to the head end of said power barrel such that said power barrel and said deceleration chamber share a common longitudinal axis;

b) a disk shaped deceleration piston having a piston assembly engaging surface and a resistance surface, said deceleration piston being slidably mounted within said deceleration chamber for longitudinal movement therein, said deceleration piston having an axial bore formed therein for slidably receiving said force transferring rod therethrough and a circular recess circumscribing said axial bore formed in said piston assembly engaging surface for receiving said piston assembly therein upon completion of an impacting stroke; and c) means for biasing said deceleration piston towards said power barrel.

4. A hand held single stroke foundry impactor for fracturing a gate or riser from a cast product as defined in claim 3, wherein said means for biasing said deceleration piston towards said power barrel further comprises a selectively actuated bi-directional deceleration chamber pressurization valve in fluid communication with said deceleration chamber proximate said substantially closed terminating end, said deceleration chamber pressurization valve being in fluid connection with a source of fluid pressure, such that said deceleration chamber can be selectively pressurized by said deceleration chamber pressurization valve, thereby biasing said deceleration piston towards said power barrel.

5. A hand held single stroke foundry impactor for fracturing a gate or riser from a cast product as defined in claim 3, wherein said deceleration piston is manufactured from a non-metallic material.

6. A hand held single stroke foundry impactor for fracturing a gate or riser from a cast product as defined in claim 5, wherein said non-metallic material is a nylon compound.

7. A hand held single stroke foundry impactor for fracturing a gate or riser from a cast product as defined in claim 6, wherein said nylon compound further comprises a heat stabilized type six polyamide resin nylon compound.

8. A hand held single stroke foundry impactor for fracturing a gate or riser from a cast product as defined in claim 1, wherein said means for isolating the longitudinal motion of said impactor from the operator thereof further comprises:

a) at least two elongated rail members rigidly mounted to said casing along the longitudinal axis of said impactor and in parallel relation to each other, said rails being rigidly mounted to said casing at a first and second terminating ends, as well as at the midpoint of said rails;

b) an operator handle assembly having a first and second handles attached thereto is slidably attached to said rail members at a first and second slidable locations, said first location being between said midpoint mount and said first terminating end of said rail member, said second location being between said midpoint mount and said second terminating end of said rail member; and c) at least one shock absorbing coil spring interstitially positioned about said rail members between said midpoint mount and said first and second slidable locations, such that said handle assembly is biased to a rest position by said at least one coil spring.

9. A hand held single stroke foundry impactor for fracturing a gate or riser from a cast product comprising:

a) an elongated outer casing having a bore axially formed therein, said bore defining a substantially circular interior power barrel having a head end and a blind end;

b) a piston assembly having an upper and lower portions slidably positioned within said power barrel, said piston assembly having a force transferring rod affixed to said lower portion and axially extending therefrom, said force transferring rod having a distal extending impacting end;

c) a substantially cylindrical deceleration chamber having a first substantially open terminating end and a second substantially closed terminating end, said substantially open end being rigidly mounted to said head end of said power barrel along a common longitudinal axis;

d) a disk shaped deceleration piston slidably positioned within said deceleration chamber having an axial bore formed therein for cooperatively receiving said force transferring rod therethrough, said deceleration piston being selectively biased towards said head end of said power barrel;

e) means for selectively introducing fluid pressure into said head end and said blind end of said power barrel, thereby selectively imparting longitudinal motion to said piston assembly within said power barrel; and f) means for isolating the longitudinal motion of said impactor from the operator thereof.

10. A hand held single stroke foundry impactor for fracturing a gate or riser from a cast product as defined in claim 9, wherein said disk shaped deceleration piston is manufactured from a non-metallic material.

11. A hand held single stroke foundry impactor for fracturing a gate or riser from a cast product as defined in claim 10, wherein said non-metallic material further comprises a nylon compound.

12. A hand held single stroke foundry impactor for fracturing a gate or riser from a cast product as defined in claim 11, wherein said nylon compound further comprises a heat stabilized type six polyamide resin.

13. A hand held single stroke foundry impactor for fracturing a gate or riser from a cast product as defined in claim 9, wherein said means for selectively introducing fluid pressure into said head end and said blind end of said power barrel further comprises:

a) at least one selectively actuated bi-directional firing valve positioned proximate said blind end of said power barrel, said at least one bi-directional valve being in fluid communication with a source of fluid pressure and said power barrel, such that upon selective actuation of said at least one bi-directional valve said blind end of said power barrel is either pressurized via the introduction of fluid pressure from said source of fluid pressure or de-pressurized via the release of fluid pressure to the atmosphere; and b) at least one bi-directional exhaust and return valve positioned proximate said head end of said power barrel, said at least one bi-directional exhaust and return valve being in fluid communication with said source of fluid pressure and said power barrel, such that upon selective actuation of said at least one bi-directional exhaust and return valve said head end of said power barrel is either pressurized via the introduction of fluid pressure from said source of fluid pressure or de-pressurized via the release of fluid pressure to the atmosphere.

14. A hand held single stroke foundry impactor for fracturing a gate or riser from a cast product as defined in claim 9, wherein said means for isolating the longitudinal motion of said impactor from the operator thereof further comprises:

a) at least two elongated rail members rigidly mounted to the exterior of said elongated casing, said rails being mounted in substantially parallel orientation to each other and along the longitudinal axis of said impactor, said rails being rigidly mounted to said casing at a first and second terminating ends, as well as at the midpoint of said rails;

b) an operator handle assembly having a first and second handles attached thereto is slidably attached to said at least two rail members at a first and second slidable locations, said first location being between said midpoint mount and said first terminating end of said at least two rail members, said second location being between said midpoint mount and said second terminating end of said at least two rail members; and c) at least one shock absorbing coil spring circumscripturally positioned upon said at least two rail members between said midpoint mount and said first and second slidable locations, said at least one shock absorbing coil spring operating to bias said operator handle assembly to a predetermined rest position, such that upon actuation of said impactor, said at least one shock absorbing coil spring absorbs to linear motion of said impactor and therefore isolates such from the operator thereof.

15. A hand held-type single stroke foundry impactor for fracturing a gate or riser from a cast product comprising:

a) an elongated outer casing having a longitudinal bore formed therein, said bore defining a power barrel having a head end and a blind end;

b) a piston assembly slidably positioned within said power barrel, said piston assembly having an upper and lower portions wherein said upper portion is of greater a diameter than said lower portion, said piston assembly having a force transferring rod longitudinally extending therefrom, said force transferring rod having a distal impacting end;

c) at least one selectively actuated valve positioned within both said head end and said blind end of said power barrel for selectively introducing fluid pressure into said power barrel for the purpose of imparting longitudinal motion to said piston assembly;

d) a substantially cylindrical deceleration chamber having a first substantially open terminating end and a second substantially closed terminating end, said substantially open end being rigidly mounted to said head end of said power barrel along a common longitudinal axis;

e) a non-metallic disk shaped deceleration piston slidably positioned within said deceleration chamber, said deceleration piston having an axial bore formed therein for cooperatively receiving said force transferring rod therethrough, said deceleration piston being selectively biased towards said head end of said power barrel; and e) a shock absorption assembly for isolating the linear motion of the impactor from the operator comprising:

i.) at least two elongated rail members rigidly mounted to the exterior of said elongated casing, said rails being mounted in substantially parallel orientation to each other and along the longitudinal axis of said impactor, said rails being rigidly mounted to said casing at a first and second terminating ends, as well as at the midpoint of said rails;

ii.) an operator handle assembly having a first and second handles attached thereto is slidably attached to said at least two rail members at a first and second slidable locations, said first location being between said midpoint mount and said first terminating end of said at least two rail members, said second location being between said midpoint mount and said second terminating end of said at least two rail members; and iii.) at least one shock absorbing coil spring positioned upon said at least two rail members between said midpoint mount and said first and second slidable locations such that said coil spring circumscribes said rail member, said at least one shock absorbing coil spring operating to bias said operator handle assembly to a predetermined rest position, such that upon actuation of said impactor, said at least one shock absorbing coil spring operates to absorb the linear motion of said impactor, and therefore isolates the impacting shock of said impactor from the operator.

16. A hand held single stroke foundry impactor for fracturing a gate or riser from a cast product as defined in claim 15, wherein said non-metallic material is a nylon compound.

17. A hand held single stroke foundry impactor for fracturing a gate or riser from a cast product as defined in claim 16, wherein said nylon compound is a heat stabilized type six polyamide resin.

* * * * *